United States Patent [19]

Theisen et al.

[11] Patent Number: 4,951,021

[45] Date of Patent: Aug. 21, 1990

[54] ELECTROMAGNETIC SWITCHING APPARATUS HAVING DYNAMICALLY BALANCED LATCH TRIP

[75] Inventors: Peter J. Theisen, West Bend; Richard G. Smith, Milwaukee; Mark A. Juds, New Berlin; Daniel A. Wycklendt, Milwaukee, all of Wis.

[73] Assignee: Eaton Corporation, Cleveland, Ohio

[21] Appl. No.: 263,844

[22] Filed: Oct. 28, 1988

[51] Int. Cl.[5] ..... M01H 9/20

[52] U.S. Cl. ..... 335/167; 335/189; 335/140

[58] Field of Search ..... 335/189, 190, 272, 167–176, 335/139–140, 131–132

[56] References Cited

U.S. PATENT DOCUMENTS

| | | | |
|---|---|---|---|
| 2,289,227 | 7/1942 | Walker | 335/272 |
| 2,496,880 | 2/1950 | Leland | 335/272 |
| 2,828,636 | 1/1958 | Hall | 335/272 |
| 2,987,657 | 6/1961 | Buchtenkirch et al. | 335/272 |
| 3,308,404 | 3/1967 | Fujita . | |
| 3,419,831 | 12/1968 | Ganowsky | 335/272 |
| 3,740,510 | 6/1973 | Grunert . | |
| 3,959,753 | 5/1976 | Wafer . | |
| 3,979,675 | 9/1976 | Maier . | |
| 3,987,382 | 10/1976 | Cataldo et al. . | |
| 3,991,391 | 11/1976 | Wafer . | |
| 4,025,883 | 5/1977 | Slade et al. . | |
| 4,077,026 | 2/1978 | Slade et al. . | |
| 4,132,968 | 1/1979 | Lang . | |
| 4,292,611 | 1/1981 | Bresson et al. . | |
| 4,307,358 | 12/1981 | Haury et al. . | |
| 4,571,565 | 2/1986 | Belbel et al. . | |
| 4,639,700 | 1/1987 | Shestak et al. . | |
| 4,660,001 | 4/1987 | Burton . | |
| 4,769,557 | 9/1988 | Hoef et al. . | |

FOREIGN PATENT DOCUMENTS

| | | |
|---|---|---|
| 1464565 | 11/1966 | France . |
| 21202/68 | 7/1964 | Japan . |

*Primary Examiner*—Leo P. Picard
*Assistant Examiner*—Lincoln Donovan
*Attorney, Agent, or Firm*—L. G. Vande Zande

[57] ABSTRACT

A linear acting ball latch is released by a rotary latch release member in the form of a rotor for a high torque, short stroke rotary electric motor which is electrically energized through a capacitor discharge system to release the latched member for spring biased movement into engagement with a bridging contact, thereby forcing the contact open from stationary contacts. A clapper type armature drives the contacts between open and closed positions through tubes, one of which extends through the latch mechanism. The tubes have spring biased plungers connected with the movable contact member to provide a low gradient spring force to the contacts permitting separation by the latch tube assembly and providing contact pressure when the magnetic operator closes the contacts. A manually operable handle and reset cam are disposed over the rotary latch mechanism and have mechanical connection with the latch release rotor to provide for manual operation of the release and for manual resetting of the latch mechanism. The wearable parts and time dated parts are all housed in a powerhead module which is readily detached from a base module and electronics module.

39 Claims, 7 Drawing Sheets

42
52
56
54
34
50
48
36
60b
60a
60b
130
38
53
50
60
46
40
44

32a
16
59
58
10c
32a
32
10a
10c
16
10a
10d
10b
10b
16
10d
10b
10
12a
14a
120
122
32a
22
38
36
30
32
120
124
24a
34
26
24
24a
28

110
106a
108
106
108
114
110
104
102e
102
102d
112
102b
102c
100
102a
102c
104
76
74b
74d
74a
74a
74b
74
74a
74c
74e
74a
74b
74c
72b
72a
72c
72
72c
72b
72b
72d
70
92
62
88d
88a
94
92a
96
98
88
86
98
90
98
88b
88c
90
68a
70
70
68
68a
84
82b
82
82a
82b
82b
82c
82b
80
80
82d
82c
82d
78b
78f
78a
78d
78c
78
78e
78b
78c
64e
64h
64a
64h
64
66
64e
64a
64f
66a
64g
64c
64f
64g
64e
64d
64f
64b
64h
64e
64g

ELECTROMAGNETIC SWITCHING APPARATUS HAVING DYNAMICALLY BALANCED LATCH TRIP

BACKGROUND OF THE INVENTION

The U.S. Government has a paid-up license in this invention and the right in limited circumstances to require the patent owner to license others on reasonable terms as provided for by the terms of Contract No. N00024-83-C-4181 awarded by the Department of the Navy.

This invention relates to electromagnetic switching apparatus such as electromagnetically operated contactors for opening and closing switch contacts. The invention further relates to such devices wherein a resettable latch may be tripped manually or remotely to open the contacts independently of the electromagnetic operating mechanism. Further the invention relates to devices as aforedescribed wherein the latch trip means is responsive to current conditions to trip the contacts open in response to predetermined current, thereby providing overload protection for devices connected with the switching apparatus. Still more specifically, the invention relates to a device of the aforedescribed type which is highly shock resistant or shockproof.

Apparatus of the aforedescribed type is commonly referred to as a combination contactor/circuit breaker or a combination starter/circuit breaker, depending on whether the apparatus incorporates overload protection in the form of an overload relay as opposed to over-current and short circuit protection as provided by the circuit breaker function. Such apparatus is provided as a single device and usually employs one set of contacts commonly operable by each function of the apparatus. Devices are presently available which generally meet and satisfy the needs for control of this type, however, there is continued demand for improvements in apparatus of this type such as reductions in size and weight, increased current handling capability, decreased operation and response time and improved resistance to mechanical shock sensitivity.

SUMMARY OF THE INVENTION

This invention provides an electromagnetically operated contactor, and which has a trippable latch mechanism to open the contacts independently of the electromagnetic operator, such latch trip mechanism being operable manually, remotely or in response to a sensed over-current or short circuit condition, thereby incorporating a circuit breaker function into the device. The apparatus is smaller and lighter than present similar apparatus and is highly shock resistant or shockproof. The apparatus of this invention is modularly packaged to incorporate wear related and age limited parts in a module that can be replaced without regard to current settings and calibration and to provide electronic parts in a second module and electrical connection and static current sensing parts in a base module. The apparatus employs a rotary latch which is symmetrical about a single axis to dynamically balance the latch and associated components, thereby virtually eliminating sensitivity of the latch to mechanical shock. A clapper type armature is used to which the movable contact assemblies are attached, and the entire armature contact assembly is dynamically balanced about the pivot axis for the armature when the apparatus is in the open condition, again to minimize susceptibility to malfunction due to mechanical shock. Other features and advantages of this invention will become more apparent when reading the following description and claims in conjunction with the accompanying drawings.

Figure 7:
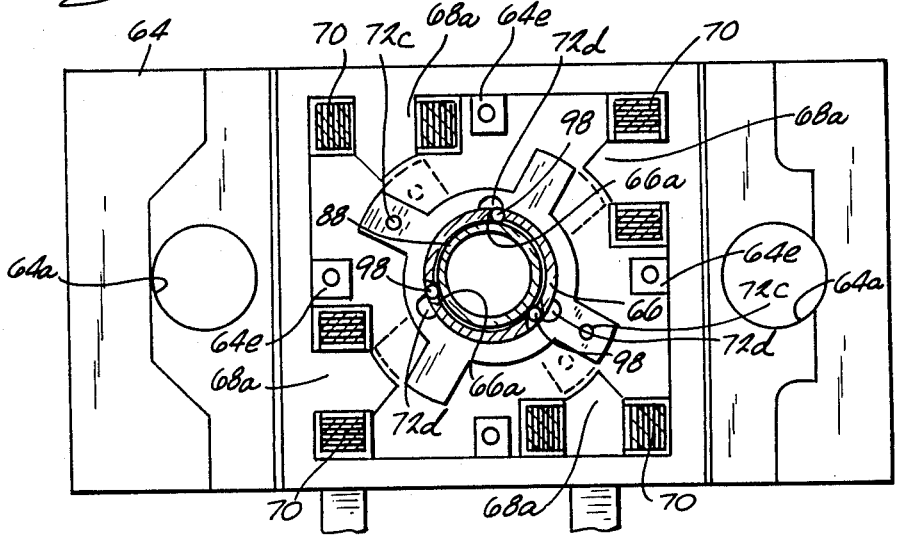
Figure 4:
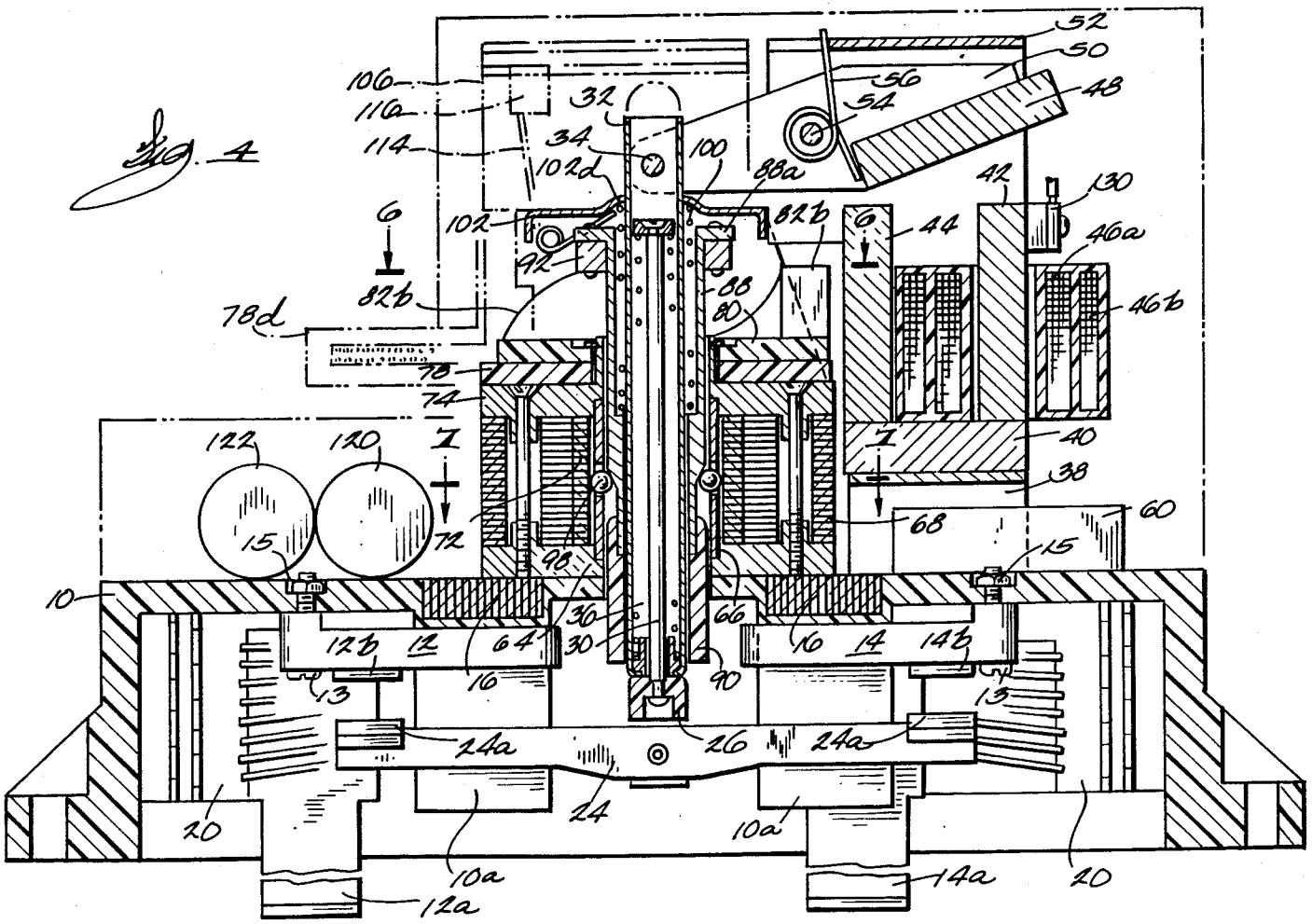
FIG. 4 is a cross sectional view taken along line 4—4 of FIG. 1.
Figure 8:
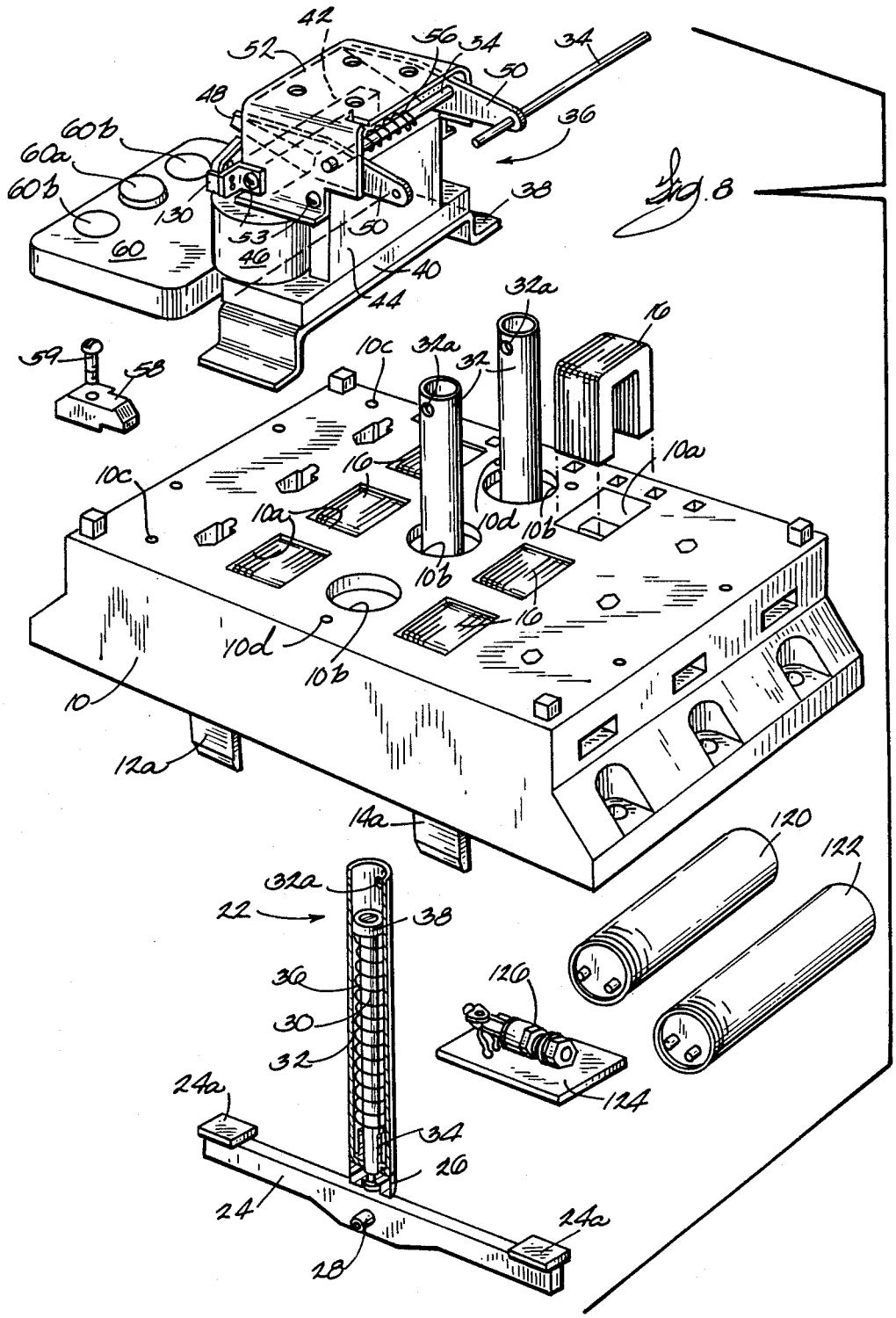
Figure 9:
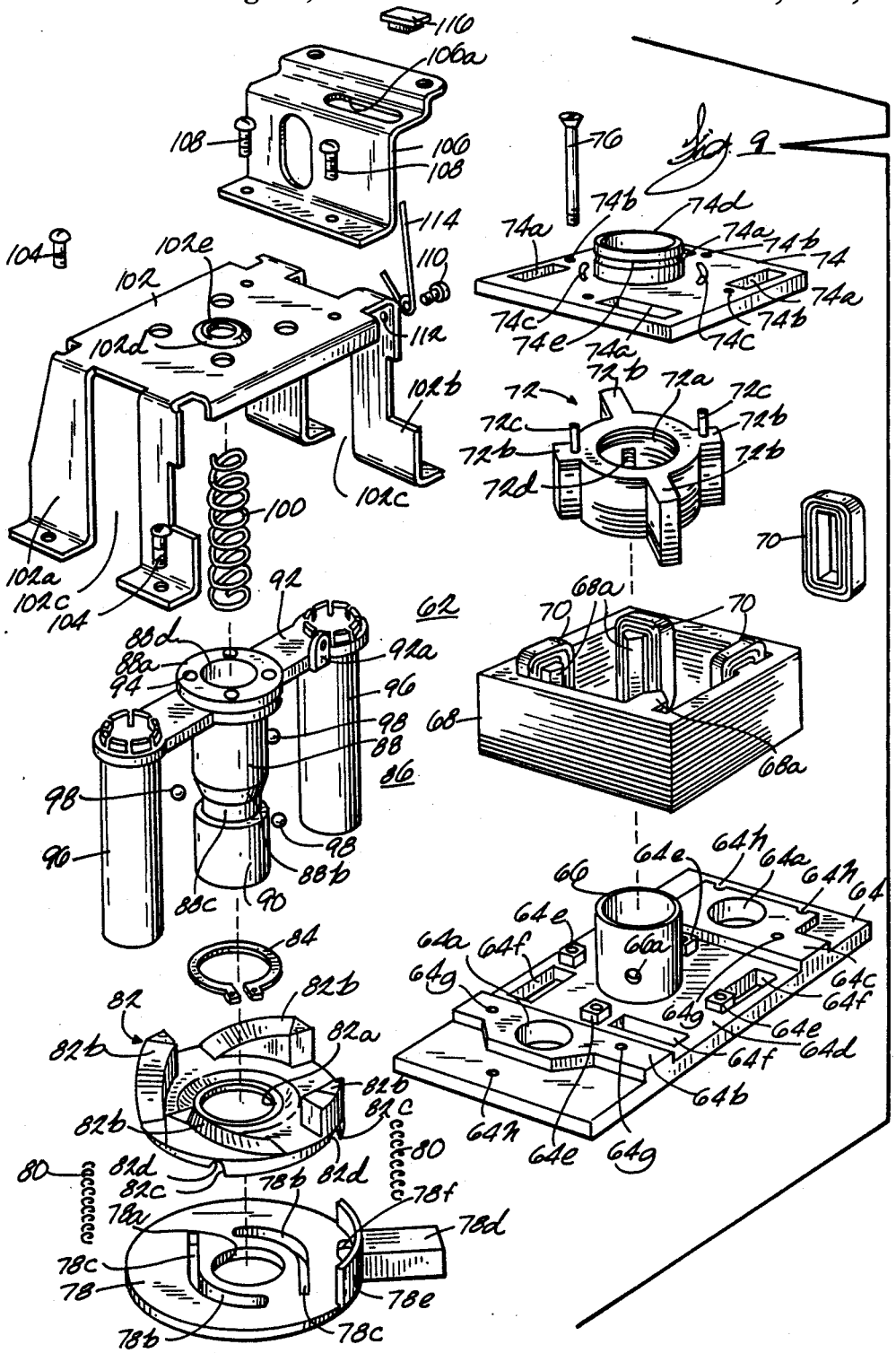

FIG. *6a* and *6b* are similar cross sectional views through a handle operator assembly associated with the latch assembly of this invention, both views taken along the line 6—6 in FIG. 4, FIG. *6a* illustrating the handle operator in the tripped position and FIG. *6b* illustrating the handle operator in the reset position;

FIG. 7 is a cross sectional view through a latch assembly of this invention taken along the line 7—7 in FIG. 4;

FIG. 8 is an exploded perspective view of elements of the powerhead assembly of this invention; and FIG. 9 is an exploded perspective view of other elements of the powerhead assembly for the electromagnetic switching apparatus of this invention.

DETAILED DESCRIPTION OF THE PREFERRED EMBODIMENTS

Figure 1:
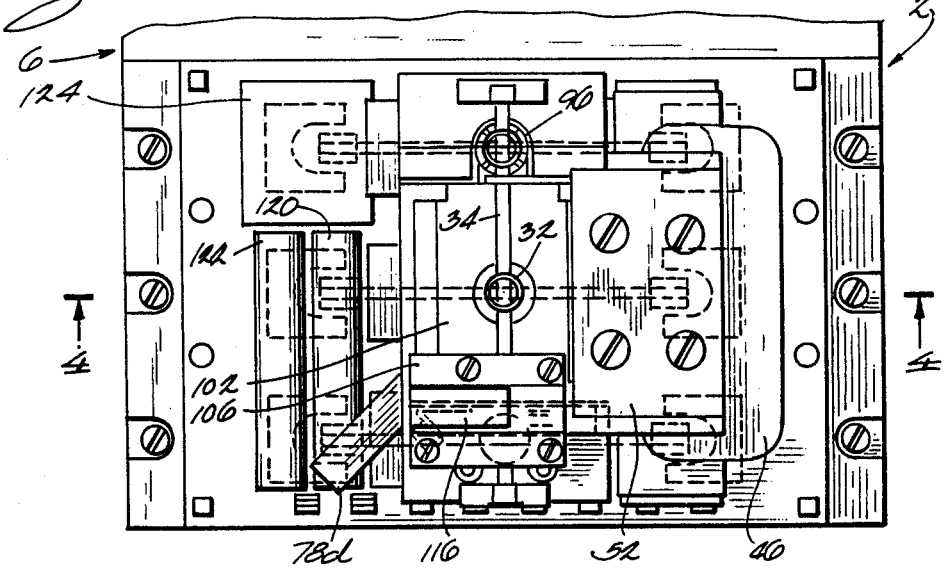
FIG. 1 is a top plan view of the electromagnetic switching apparatus of this invention with a molded cover removed from a powerhead module.
Figure 2:
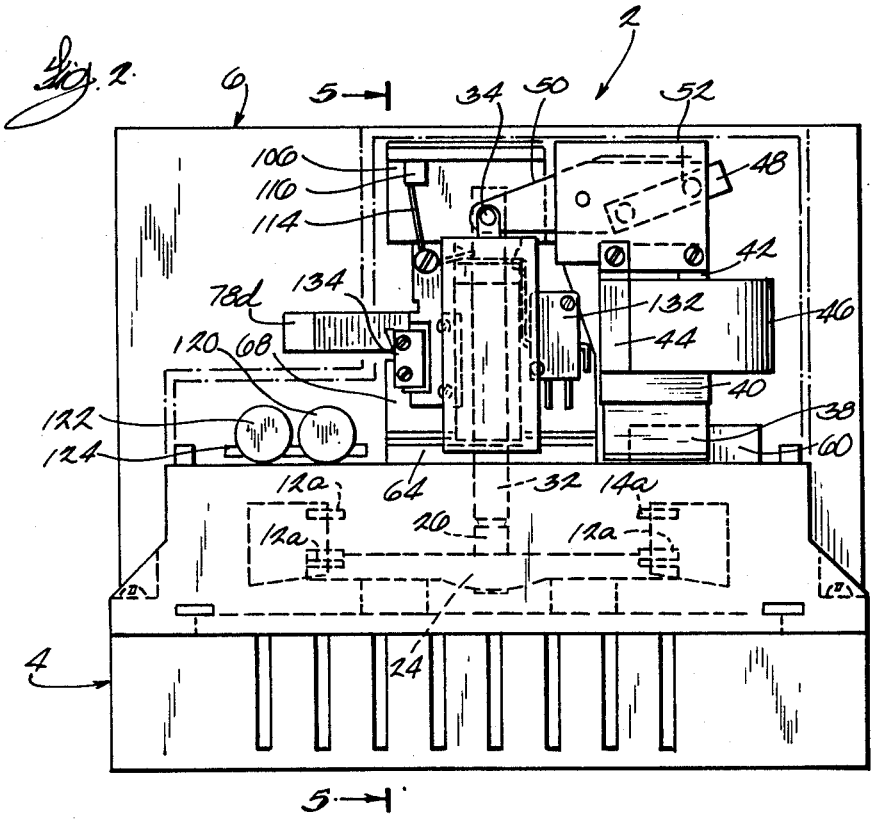
FIG. 2 is a side elevational view of the apparatus as seen in FIG. 1 with the molded cover shown in broken lines.
Figure 3:
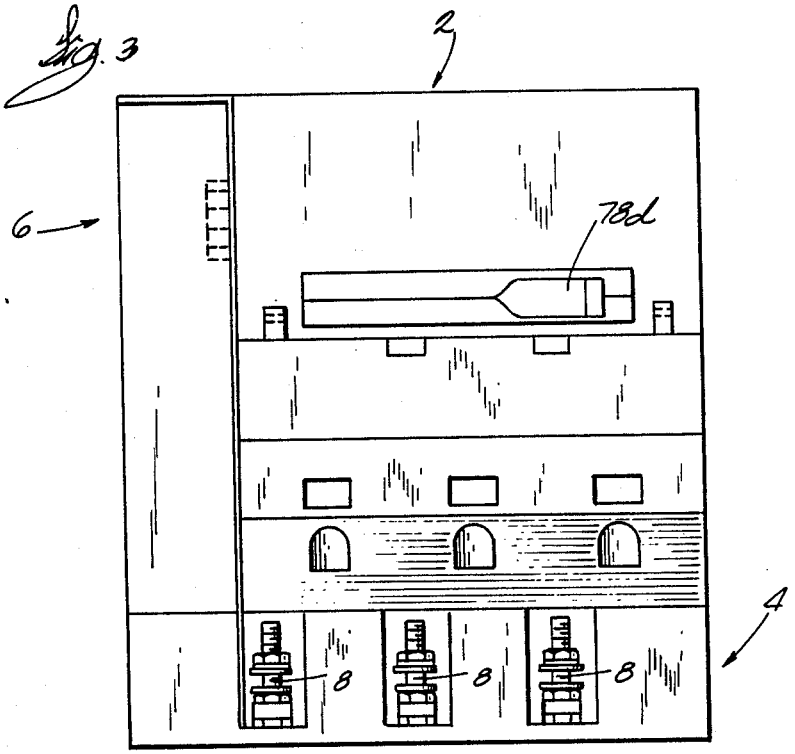
FIG. 3 is an end elevational view of the apparatus of FIGS. 1 and 2 as seen from the left-hand end of FIG. 2, with the molded cover for the powerhead module in place.

Referring to the drawings, the electromagnetic switching apparatus of this invention is shown in top plan, side elevation and end elevation, respectively, in FIGS. 1, 2 and 3. The apparatus comprises an electromagnetically operated switching device for opening and closing main contacts upon command, and a latch for tripping open the main contacts in response to manual operation or electric operation controlled by a remote signal or controlled by a sensed current overload or short circuit condition or in response to other overload or under-voltage conditions.

This invention arranges the components and elements of such an apparatus into three major modules, one of which is termed a powerhead module 2 and contains all of the parts subject to aging, shelf life or which are wearable or replaceable. The powerhead module is plug-in connected to a base module 4 which has power terminals for connection to external apparatus and power supplies and may include current sensing modules (not shown). Also attached to base module 4 is an electronics module 6 which stands alongside powerhead module 2. Not specifically shown are multiple pin connectors for interconnection of powerhead module elements with various control circuits and logic boards housed within the module 6.

Referring also to the remaining drawings and particularly to FIGS. 8 and 9, the powerhead module is primarily built on a midmolding 10 of insulating material which is essentially in the shape of a rectangular box open to the bottom. Midmolding 10 houses three sets of stationary contacts 12, 14 attached to the upper wall of the molding by screws 13 and nuts 15. Contacts 12 and 14 are essentially horizontally U-shaped members which extend around one respective leg of molded inverted U-shaped pockets 10*a* which receive laminated flux concentrators or slot motors 16 inserted therein from the upper surface as shown in FIG. 8. The slot motors 16 may be retained within the pockets 10*a* by filling the remaining void areas within the pocket with a potting material. Stationary contacts 12 and 14 are offset downwardly to provide plug-in stab members 12*a* and 14*a* which are cooperably received within jaw contacts 18 (FIG. 5) connected to terminals 8 within base 4. Contact tips 12*b* and 14*b* are brazed to the respective stationary contact support members. Also enclosed within the interior portion of midmolding 10 are arc extinguishing assemblies 20 which comprise perforated barriers and U-shaped splitter plates arranged in spaced stacked relation around the respective contacts in a well known manner.

Midmolding 10 is provided with three circular apertures 10*b* spaced intermediate aligned pairs of pockets 10*a* (see particularly FIG. 8). Three movable contact assemblies 22 are provided, each comprising a bridging contact bar 24 having contact tips 24*a* attached to the opposite ends thereof. Bar 24 is pinned within a slot in the end of a cylindrical insulator coupling 26 by a spring pin 28. A long thin rod 30 is affixed to the closed upper end of insulator coupler 26 by riveting or the like. An elongated tube 32 having a lower end turned inwardly to form a narrow annular lip is disposed over rod 30 together with a flanged bushing 34, the flange of bushing 34 resting on the lip of tube 32. A long, low gradient coil compression spring 36 is disposed over rod 30 to bear against the upper side of the flange of bushing 34. A washer 38 is attached to the upper end of rod 30 by a screw to provide a headed end for the rod against which the upper end of spring 36 seats. Washer 38 also serves as a guide for axial movement of rod 30 within tube 32 as the movable contact 24 and insulator coupler 26 pull rod 30 axially outwardly of tube 32 to extend the cylindrical portion of the movable contact assembly as will be described hereinafter. Tube 32 is also provided with a pair of openings 32*a* through the upper end thereof for connection to an axle 34 of a movable armature assembly.

An electromagnetic operator assembly 36 is shown in perspective in FIG. 8. A shallow inverted U-shaped bracket 38 has an elongated rectangular magnetic yoke 40 attached thereto. Upstanding front and rear magnet poles 42 and 44, respectively, are attached to the upper face of yoke 40 by screws (not shown) which extend through the bracket 38 and yoke 40 into threaded holes in the poles 42 and 44. A dual winding coil 46 is placed over front pole 42. An armature assembly comprising a rectangular armature 48 having side plates 50 attached to its opposite edges by screws (not shown) or other suitable means is pivotally supported in a bracket 52, which is attached to the upper ends of poles 42 and 44 by screws 53, by an elongated axle pin 54 extending through aligned holes in bracket 52 and in respective side plates 50. A torsion spring 56 is disposed over axle pin 54 and has one end leg in engagement with armature 48 and the other end leg engaging bracket 52 within a slot formed therein to provide an upward rotational bias to the armature assembly, urging armature 48 away from the faces of poles 42 and 44 as seen specifically in FIG. 4. Electromagnetic operator assembly 36 is held to the upper surface of midmolding 10 by a pair of clamps 58 (only one of which is shown in FIG. 8) which are held to the upper surface of midmolding 10 by screws 59 which take into threaded holes 10*c* in midmolding 10, an offset portion of each clamp 58 overlying a flange on bracket 38 to clamp the latter to the upper surface of midmolding 10. Alternatively, clamps 58 may be omitted and holes be provided in the flange of bracket 38 whereby screws 59 may secure the bracket by passing through such holes. A potted electronic D.C. driver package 60 for the electromagnetic operator 36 is positioned under that assembly in the space defined by bracket 38. The package 60 may be held in place by potting material or a suitable adhesive. Although not specifically dealt with in this application, the package 60 directly receives line voltage such as three phase, 480 volts. An isolation transformer 60*a* isolates the control logic circuitry within package 60 from the line voltage. A pair of transistors 60*b* are also visible in FIG. 8.

The pivoted armature assembly of electromagnetic operator assembly 36 provides a clapper type armature for the apparatus wherein upon energization of the pickup and holding coils 46*a* and 46*b* (FIG. 4), armature 48 and its side plates 50 pivot about axle 54 to seat armature 48 against the upper faces of pole pieces 42, 44. This movement raises axle 34, which is attached between the outer ends of side plates 50 and is connected to tubes 32 through holes 32*a*, to raise the movable contact assemblies 22, causing the bridging contact 24 and its contact tips 24*a* to engage stationary contact tips 12*b* and 14*b*, respectively. Contact pressure for this engagement is provided by spring 36 within the tube 32 as the final movement of the armature assembly effects axial extension of the cylinder portion of the movable contact assemblies. Movable contact bar 24 moves within the molded slot of the pockets 10*a* to move into the closed end of the slot motors 16. In the event of a short circuit current of a predetermined magnitude, the reverse current paths formed by the respective stationary contact leg disposed within the slot of the slot motor pocket 10*a* and the bridging contact bar 24 effect a blow open magnetic force between the movable and stationary contacts. The low gradient spring 36 is compressed further as the movable contact 24 moves away from the stationary contacts, thereby further axially extending the cylinder portion of the movable contacts.

A latch assembly 62 is provided for effecting separation of the movable contact 24 from the stationary contacts 12, 14 independently of the operation of electromagnetic operator 36, the latch assembly being operable by either manual or electromagnetic means. Latch assembly 62 is shown in exploded perspective view in FIG. 9 as well as in cross sectional views 4 and 7. The latch assembly comprises a lower end plate 64 formed of brass or other non-ferrous material having a central shouldered aperture in which a cylindrical sleeve bearing 66 is positioned. End plate 64 also has a pair of through apertures 64*a* spaced on either side of the central aperture. Raised portions 64*b* and 64*c* adjacent opposite ends of end plate 64 define a recessed central area 64*d* in which are formed four upstanding rectangular bosses 64*e* having threaded holes therein located on the orthogonal coordinates. Rectangular apertures 64*f* are uniformly located adjacent bosses 64*e*.

A laminated rectangular stator assembly 68 has four inwardly directed poles 68*a* formed near respective interior corners of the stator. Arcuate pole faces 68*b* are machined on the distal ends of poles 68*a* after assembly of the stator laminations. Four foil wound coils 70 are disposed over poles 68*a*. Stator 68 is positioned on end plate 64 such that the lower ends of coils 70 are disposed within the apertures 64*f*. The stator is positioned laterally by the upstanding end portions 64*b* and 64*c* as well as by the upstanding bosses 64*e* which engage the interior edge of the stator assembly 68. Although not shown, the coils 70 are serially connected internally of the stator assembly and the respective leads for the serially connected coils are brought out between end plate 64 and stator 68 through suitable slots (not shown).

A laminated rotor 72 having a machined internal cylindrical surface 72*a* is disposed over sleeve bearing 66 and is journaled for rotation thereon. Rotor 72 has four pole extensions 72*a* formed on the exterior surface thereof at 90° intervals. The distal ends of pole extensions 72*b* are machined to provide pole faces for the rotor. A pair of pins 72*c* extend upwardly from two of the pole extensions 72*b* in diametrically opposed relation. An upper end plate 74 is positioned over the top of stator 68. End plate 74 has four rectangular bosses similar to bosses 64*e* depending from an inner surface which position the cover on the rectangular housing formed by the side walls of stator 68. End plate 74 also has rectangular apertures 74*a* which overlie the projecting portions of coils 70 to provide clearance therefor. A central aperture is provided in end plate 74 which has a shouldered recess for overlying the upper end of sleeve bearing 66, thereby positioning the upper end of that member. Four screws such as 76 in FIG. 9 extend through holes 74*b* in end plate 74 and threadably engage the holes in rectangular bosses 64*e* in end plate 64 to hold the entire assembly together. Arcuate slots 74*c* are provided in end plate 74 through which pins 72*c* extend. A hub 74*d* is formed on the outer surface of end plate 74 around the central aperture in that plate and has an annular groove 74*e* formed near its upper end. It may be recognized that the stator 68, rotor 72, end plates 64 and 74 and serially connected coils 70 form an electric motor. The limits of rotor movement are defined by the amount of travel of pins 72*c* within arcuate slots 74*c*. The initial position of the rotor 72 is shown in FIG. 7 in solid lines and its displaced or energized position is shown in dotted lines wherein the pole faces of the rotor and of the stator are in direct registration.

A manual handle operator 78 has a central opening 78*a* which is received over hub 74*d* to journal the handle operator 78 for rotation thereon. Handle operator 78 is essentially a flat disc of insulating material which overlies the upper surface of end plate 74 in flush contact therewith. A pair of arcuate slots 78*b* overlie slots 74*c* and receive the distal ends of pins 72*c* therein. Slots 78*b* have tangential straight portions 78*c* continuous therewith and receive helical compression springs 80 therein which bear between the ends of straight portions 78*c* of the slots 78*b* and the edges of pins 72*c* of rotor 72 to bias the rotor to its deenergized position shown in solid lines in FIG. 7. A handle 78*d* projects outwardly from the main body of handle operator 78 and has an arcuate upstanding shield 78*e* formed adjacent therewith to prevent damage to the fingers of an individual operating the handle. Handle 78*d* is hollow and has a spring biased drive pin extending radially inward from the handle. Rotation of handle operator 78 in a clockwise direction as viewed in FIG. 9 or in FIGS. 6*a*, 6*b* will move the ends of the arcuate portions of slots 78*b* into engagement with pins 72*c* of rotor 72 to drive the rotor to its extreme clockwise position as determined by the ends of smaller arcuate slots 74*c* in end plate 74.

A reset cam 82 has a central aperture 82*a* and is also disposed over hub 74*d* to be journaled for rotation thereon coaxially with handle operator 78. A snap ring 84 is attached within annular groove 74*e* to retain the handle operator 78 and cam 82 assembled to hub 74*d*. The configuration of cam 82 is arranged in four quadrants. It has four ramp surfaces 82*b* formed on the upper surface. Adjacent the lower surface, a ratchet cam track is formed which has four drive shoulders 82*c* located at 90° intervals. The shoulders 82*c* are engagable by drive pin 78*f* to drive the cam 82 counterclockwise. Semicircular detent recesses 82*d* are formed adjacent drive shoulders 82*c*. The surface of ratchet cam track between each detent 82*d* and the next drive shoulder 82*c* is an arcuate cam surface of increasing radius which cams the drive pin 78*f* inwardly of the handle until it passes over the shoulder 82*c*.

A latch tube assembly 86 comprises a flanged center tube 88 having an upper flange 88*a* and a frustoconical relieved latching surface 88*b* leading to a reduced diameter lower end 88*c*. A plastic tube extension 90 is affixed to the lower reduced diameter portion 88*c*. A cross bar 92 has a central aperture which is disposed over the main portion of center tube 88 and is positioned against the underside of flange 88*a*. A plurality of rivets 94 secure cross bar 92 and center tube 88 together. The ends of cross bar 92 are provided with outer latch tubes 96 which are spaced outwardly to correspond coaxially with the apertures 10*b* in midmolding 10. Latch tube assembly 86 is inserted into and through the hub 74*d* and sleeve bearing 66 to project out the bottom end of bottom end plate 64. However, prior to such insertion, three ball bearings 98 are positioned in holes 66*a* formed in the wall of sleeve bearing 66 whereupon said bearing 66 serves also as a ball cage, retaining the balls against the interior cylindrical surface 72*a* of rotor 72. The exterior surface of center tube 88 engages the balls on the opposite side of bearing 66 to keep the bearings from falling out of the holes. As seen in FIG. 7, holes 66*a* are drilled at a forward angle with respect to direction of rotation of the rotor 72 when moving from its energized to its original solid line position to facilitate movement of the balls to a latching position without binding. Center tube 88 has a stepped internal diameter 88*d* against which the lower end of a spring 100 is disposed. A bracket 102 has a pair of side legs 102*a* and 102*b* which are bifurcated to provide slots 102*c* therein to provide clearance for the width of cross bar 92. The top portion of bracket 102 is provided with a central raised boss 102*d* which has a central aperture 102*e* therein. Raised boss 102*d* provides a corresponding recessed portion on the under side of bracket 102 which receives the upper end of spring 100 to position that spring therein. When the bracket 102 is attached to lower end plate 64 by screws 104 threadably engaging holes 64*g*, spring 100 is compressed, urging the latch tube assembly 86 downwardly. When the rotor 72 is in its original position, the interior cylindrical surface 72*a* holds the balls 98 extended into the interior of sleeve bearing 66 and against the frustoconical latching surface 88*b* of center tube 88, thereby latching the latch tube assembly in a raised position. As seen in FIGS. 7 and 9, the interior surface 72*a* of rotor 72 is provided with three equally spaced recesses 72*d* which become aligned with holes 66*a* when rotor 72 is rotated to a latch release position shown in dotted lines in FIG. 7. In this position, the balls 98 can move into the recesses **72*d*, thereby moving out of the way of the main surface of center latch tube 88 and permitting the latch tube assembly to be driven downwardly under the strong bias of spring 100. The entire latch assembly is mounted to the surface of midmolding 10 by screws (not shown) which extend from the under side of the upper surface of midmolding 10 through holes 10*d* to take into holes 64*h* in lower end plate 64**.

An indicator assembly is also provided on the latch assembly. A bracket 106 is secured to the top surface of bracket 102 by screws 108. Bracket 106 is essentially a Z-shaped member having a slot **106*a* in its upper horizontal leg. A shouldered screw 110 is screwed into a hole 112 in bracket leg 102*b* to pivotally mount a spring wire lever 114 to the assembly. Wire 114 is essentially an L-shaped member wound with a loop at the junction of the two legs. The shorter of the two legs extends through a hole in a flange 92*a* formed on cross bar 92 while the longer of the two legs of wire lever 114 extends upwardly into an opening in a plastic indicator 116 which is slidably disposed in elongated slot 106*a*. Indicator 116** is a multicolor member which is visible through a window (not shown) in a molded cover for the powerhead unit.

Figure 5:
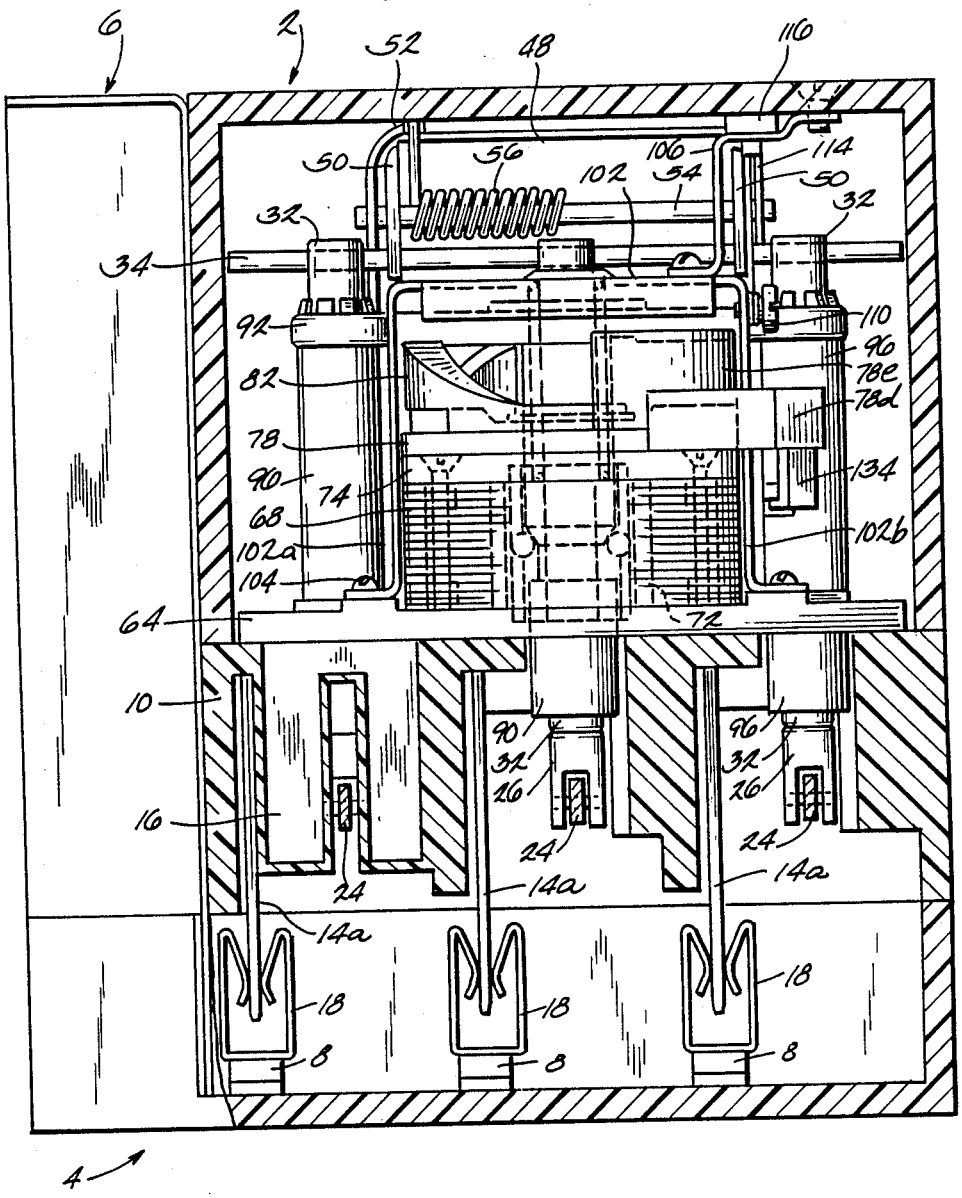
FIG. 5 is a cross sectional view taken substantially along line 5—5 of FIG. 2.

As seen in FIG. 5, the tube 32 for the center movable contact assembly 22 extends through center latch tube 88, the entire latch motor assembly 62 and the aperture **102*e* in bracket 102 to be connected to axle 34 of the armature assembly. The outer two movable contact assemblies 22 have their tubes 32 extending through outer latch tubes 96 to be attached to axle 34**.

The operation of the electromagnetic switching apparatus, and particularly with regard to the latch trip mechanism, will now be described. Referring to FIG. 4, the apparatus is shown in the contact open position wherein the electromagnetic operator 36 is deenergized and the armature 48 is biased to its open position. The latch mechanism is shown in FIG. 4 in its set, or latched, position wherein center tube 88 of latch tube assembly 86 is held in its upward position against the bias of spring 100 by engagement of balls 98 with the frustoconical latching surface **88*b*. It may be seen that the lower end of extension 90 is disposed around the cylinder comprising tube 32 and coupler 26 of the center movable contact assembly 22. Similarly, the latch tubes 96 are disposed about the cylinders comprising tubes 32 and coupling members 26 of outer movable contact assemblies 22. With the latch mechanism in this position, the electromagnetic operator 36 may be energized to attract armature 48 to the upper faces of poles 42, 44, thereby pivoting the side plates 50 clockwise about axle 54 and raising the outer axle 34 and the attached tubes 32 to a contact closed position whereby bridging contacts 24*a* are in engagement with stationary contacts 12*b* and 14*b*. The amount of upward travel of tubes 32 by armature side plates 50 and axle 34 is greater than the amount of clearance between movable contacts 24*a* and stationary contacts 12*b*, 14*b*. Therefore, after engagement of the contacts, the insulator coupler 26 and rod 30 remain fixed with the contact cross bar 24 and tube 32 moves upwardly, axially separating tube 32 from insulating coupler 26 compressing the spring 36** to provide contact pressure for the contacts.

Figure 6A:
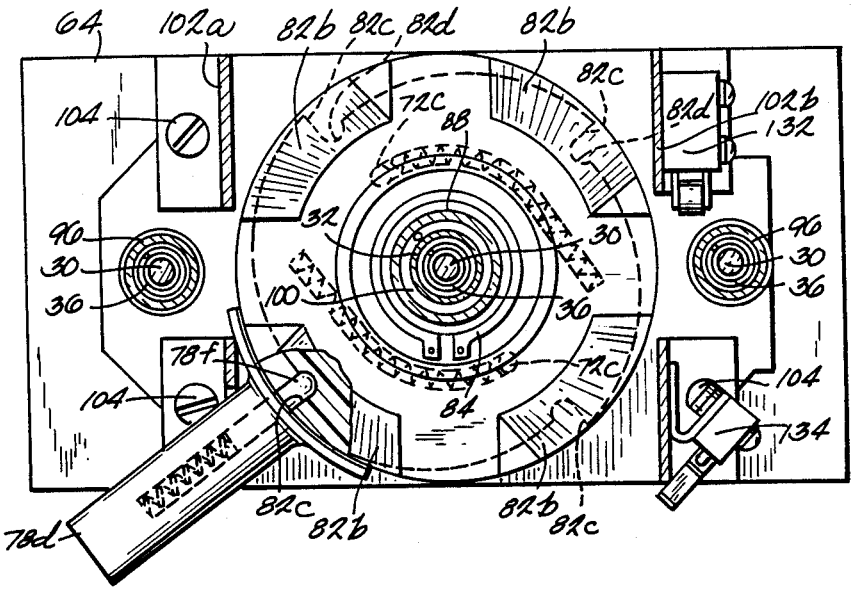
Figure 6B:
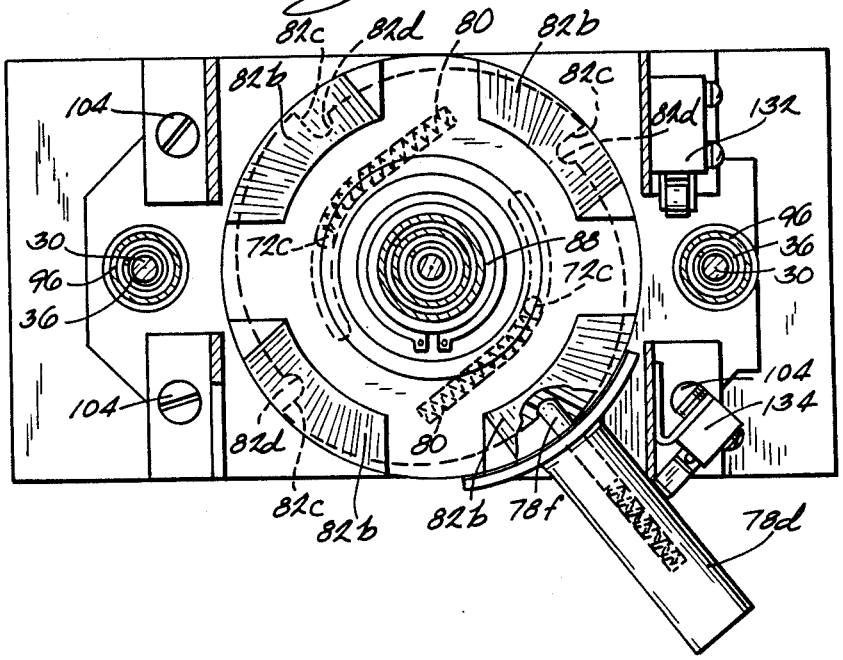

While the contacts are closed, it may be desired to manually trip the contacts open to defeat the electromagnetic operation of the device which may be controlled from a remote location and the tripping can be accomplished by rotating handle **78*d* counterclockwise from the position shown in FIG. 6*b* to the position shown in FIG. 6*a*. Initial movement in this direction is resisted by the engagement of pin 78*f* within detent recess 82*d* which helps to maintain the handle 78*d* in the set position of the latch. As the handle moves clockwise, or to the left, the ends of arcuate portions of slots 78*b* pick up the pins 72*c* of rotor 72 and rotate it clockwise to its release position wherein the recesses 72*d* are aligned with holes 66*a* in bearing sleeve 66 to permit the balls 98 to move outwardly into the recesses and release the center latch tube 88. When released, spring 100 forcefully drives the entire latch tube assembly downward whereby the ends of latch tube extension 90 and outer latch tubes 96 abut the top surfaces of the respective bridging contact cross bar 24 to drive the cross bar downward, opening the contacts 24*a* from stationary contacts 12*b*, 14*b*. Spring 100 is sufficiently strong to overcome the low gradient springs 30 in the movable contact assemblies. Handle 78*d* is moved further clockwise to cause pin 78*f* to extend over the next adjacent shoulder 82*c* to prepare the handle operator for movement to a next indexed position of the cam 82 whereby the latch may be reset. Movement of handle 78*d* from the position shown in FIG. 6*a* to the position shown in FIG. 6*b* rotates the handle and cam 82 counterclockwise, causing the ramp surfaces 82*b* of those two ramps which are positioned immediately clockwise of the cross bar 92 to be indexed to their next position. These surfaces engage the under side of cross bar 92 and drive the latch tube assembly upward against the bias of spring 100 until latch surface 88*b* comes into alignment with holes 66*a* in sleeve bearing 66, whereupon balls 98 move outwardly into the relieved diameter portion 88*c* immediately adjacent frustoconical latching surface 88*b*. This movement of the handle also moves the arcuate slots 78*b* out of engagement with pins 72*c* whereupon springs 80 bias the rotor 72 to its solid line position as seen in FIG. 7, moving the recesses 72*d* out of alignment with the holes 66*a* and bringing the surface 72*a* into engagement therewith to hold the balls in interference with the latching surface 88*b*. In this manner the latch is reset through mechanical manual operation of the handle 78*d***, thus storing sufficient potential energy in an astable condition which may be released by a low level activation energy.

The latch may also be electrically tripped to open the contacts from a remote location. As aforedescribed, the coils 70 are wired in series and the leads for the coils are brought out through the housing of the latch assembly. A pair of capacitors 120 and 122 are positioned on the top surface of midmolding 10 by a suitable means such as epoxy or the like. The capacitors are connected through suitable wiring to a printed circuit board 124 to which a SCR 126 is attached and to which the foil leads of the serially connected coils 70 are attached. While the details of the circuit are not included in this application, the coils 70 are energized upon command by discharge of one or the other of the capacitors 120, 122 through the SCR 126 and the circuitry of printed circuit board 124 to provide a rapid discharge of energy to the coils, thereby causing rotor 72 to rotate clockwise as viewed in FIG. 7 to the dotted line position wherein the faces of the rotor poles **72*b* are in registration with the faces of stator poles 68*a*. This movement in response to the electrical energization of coils 70 is the same as the mechanical motion previously described in conjunction with movement of the handle operator 78 to the position shown in FIG. 6***a*. In the same manner, the balls 98 move into the recesses 72*d* of rotor 72 to release the latch tube assembly 86 for opening the contacts as previously described. Although the latch is released electrically, it is necessary to manually reset the latch by rotating the handle 78*d* to the left-hand position as shown in FIG. 6*a* to pick up the next drive shoulder 82*c* of cam 82 and then rotating the handle to the right-hand position as viewed in FIG. 6*b* to reset the latch tube assembly as previously described. Either capacitor 120 or 122 is capable of storing and discharging sufficient energy to energize the coils, and the provision of two such capacitors is a redundancy designed into the circuit for safety. This stored electrical energy produces the low level activation energy to release the mechanically stored potential energy previously referred to.

The latch assembly 62 may also be made to operate electrically in response to the sensing of a predetermined overload current condition, thereby to function as a circuit breaker. It has previously been described that the contacts are arranged in a turn-back manner so as to provide blow open forces upon high short circuit conditions. Although not specifically shown, current sensors may be placed in the base 4 to monitor current in the apparatus. Upon detecting an overload current of predetermined magnitude, the signal generated by the current sensors can be fed to the capacitor discharge circuit for energizing the latch trip assembly 62 as heretofore described, thereby opening the contacts of the apparatus.

The electromagnetic switching apparatus of this invention is provided with various electrical interlock devices to operate and send signals through logic in the electronic module 6 providing various safety features for the device. One such device is a snap action switch 130 mounted to bracket 52 as shown in FIGS. 4 and 8. The actuator arm for switch 130 is engaged by armature 48 as the same seats upon the pole faces of poles 42 and 44, signaling that the armature has moved to its closed position. The logic within module 6 then modifies the control signal to coil 46 to drop out the pickup coil, maintaining only the hold coil energized to maintain the armature closed and magnet operator operated.

Another snap action switch 132 is positioned to bracket leg 102*b* as shown in FIG. 2. This switch has a roller actuator which is disposed in the path of cross bar 92 of latch tube assembly 86. When the latch is engaged and the latch tube is in the latched position as shown in FIG. 4, the cross bar 92 holds the actuator of snap switch 132 depressed to provide a signal to the apparatus that the latch assembly is in the latched position. This may be used for remote monitoring of the condition of the apparatus when the condition cannot be visually observed by the position of indicator 116 within the window.

Another miniature snap action switch 134 is positioned on the rear leg 102*b* as shown in FIGS. 2 and 6*a* and 6*b*. The actuator of switch 134 extends into the path of handle 78*d* so as to be held depressed, and the switch 134 actuated, when the handle operator 78 is in the position shown in FIG. 6*b*, i.e. the latch set position of the handle operator. This completes a circuit to hold the coil 46 energized, and opens a circuit to drop out the coil 46 in the event the handle 78 moves away from the switch 134 and the latch set position as shown in FIG. 6*b*.

The electromagnetic switching apparatus aforedescribed is more compact than present devices inasmuch as the main operator and contact structures are located on opposite sides of the latch trip device instead of having the latch trip device cascaded on top of the assembly. Moreover, this latch trip device is dynamically balanced about a common rotational axis and is therefore insensitive to mechanical shock conditions. The armature assembly is dynamically balanced about its rotational axis when in the open condition to also render the contact mechanism insensitive to mechanical shock. The elements which are subject to mechanical wear, electrical erosion and time factor fatigue are all located in a replaceable powerhead module which is readily plugged into the base and plug-in connected to the electronic module. While the apparatus has been described in conjunction with a preferred embodiment, it is to be understood that it is susceptible of various modifications without departing from the scope of the appended claims.

We claim:

1. Electromagnetic switching apparatus comprising:

an electromagnet having an armature biased to an open position and movable to a closed position upon energization of said electromagnet;

spaced pairs of stationary contacts; movable contacts disposed to bridge respective pairs of said stationary contacts;

contact carrier means reciprocally movable in said apparatus and coupled to said armature, said movable contacts being resiliently affixed to said contact carrier means and movable therewith into and out of bridging engagement with said stationary contacts as said armature moves between closed and open positions, respectively, said movable contacts being biased with respect to said carrier means in a contact closing direction;

rotary latch means symmetrical about an axis of rotation thereof comprising:

an axially movable latch member having angularly relieved latching surfaces;

a spring biasing said latch member for axial movement;

a ball cage disposed around said latch member positioning a plurality of balls in engagement with said latch member, said balls individually being axially aligned with a respective one of said latching surfaces;

a latch release member disposed around said ball cage, said latch release member having an axially concentric internal cylindrical surface engaging said balls and holding said balls in engagement with said latching surfaces to restrain said latch member axially displaced against said spring bias in a latched position, said latch release member further having recesses in said internal cylindrical surface circumferentially aligned with said balls, said latch release member being rotatable about said axis to a release position wherein said recesses are aligned with said balls, permitting said balls to move into said recesses, releasing said latch member for axial movement by said spring; and means responsive to said latch member axial movement driving said movable contacts out of bridging engagement with said stationary contacts against said bias with respect to said carrier means.

2. The apparatus defined in claim 1 wherein said latch release member comprises a rotor of a partial revolution electric motor formed symmetrical about said axis of rotation, said motor effecting electrically controlled release of said latch means.

3. The apparatus defined in claim 2 wherein said motor comprises:

a stator defining a continuous exterior housing wall of said motor held between a pair of end plates, said stator having a plurality of inwardly extending poles having pole faces formed on the distal ends thereof;

electric coils disposed over said poles adapted to be series connected to a controlled source of electric power;

a cylindrical sleeve bearing axially held between said end plates coaxially with said axis of rotation, said sleeve bearing having a plurality of equally spaced holes therein and comprising said ball cage; and said rotor internal cylindrical surface is rotatably journaled on said sleeve bearing, said rotor having a plurality of outwardly extending poles equal in number to said inwardly extending poles of said stator equally spaced around an outer surface of said rotor, the distal ends of said rotor poles having pole faces formed thereon to be in close radial proximity to said stator pole faces as said rotor rotates, said rotor having an initial position wherein said rotor pole faces are rotationally displaced from said stator pole faces and said balls are held in latching engagement with said latching surfaces, and wherein energization of said coils effects rotation of said rotor to said release position wherein respective rotor pole faces align with said stator pole faces.

4. The apparatus defined in claim 3 wherein one of said end plates has a pair of apertures and said rotor has a pair of pins projecting from an end surface thereof into said apertures, abutment of said pins against internal edges of said apertures limiting said rotor to movement between said initial position and said release position.

5. The apparatus defined in claim 4 further comprising a handle operator mounted on said one end plate and rotatable about said latch means axis of rotation and having means engagable with said pins, said handle being manually operable to drive said rotor to said release position.

6. The apparatus defined in claim 5 wherein said means engagable with said pins comprises openings in said handle operator, said openings being juxtaposed said apertures in said end plate and concentric therewith about said axis of rotation, and said pins project through said apertures into said openings.

7. The apparatus defined in claim 6 wherein said means engagable with said pins further comprises springs disposed in said openings abutting said pins, said springs biasing said rotor to said initial position thereof.

8. The apparatus defined in claim 7 further comprising cam means coaxially rotatable with said handle operator, said cam means driving said latch member axially against said spring bias to a latched position, wherein said balls engage said latching surfaces, wherein said handle operator is rotated in a direction to permit movement of said rotor to said initial position, thereby to hold said balls in engagement with said latching surfaces.

9. The apparatus defined in claim 8 wherein said handle operator is rotational relative to said cam means in a direction to effect movement of said rotor to said release position.

10. The apparatus defined in claim 9 wherein said handle operator moves said cam means to a non-interfering position with respect to spring biased axial movement of said latch member after said latch member becomes latched.

11. The apparatus defined in claim 10 wherein said latch member blocks reverse rotational movement of said cam means when said latch member is in said latched position, thereby to prevent said cam means from moving to an interfering position with respect to spring biased axial movement of said latch member.

12. The apparatus defined in claim 11 wherein said cam means further comprises a ratchet cam track and said handle operator comprises a spring biased pin follower engaged with said ratchet cam track to drive said cam means only in a direction that effects movement of said latch member to said latched position.

13. The apparatus defined in claim 12 wherein said ratchet cam track comprises a plurality of positive drive shoulders engagable by said pin follower to drive said cam means, said shoulders being equally spaced at intervals wherein movement of said handle operator between extreme positions thereof indexes said cam means from a non-interfering position through a latch member relatching drive increment to a subsequent non-interfering position.

14. The apparatus defined in claim 13 wherein said ratchet cam track further comprises a recess adjacent each positive drive shoulder, said pin follower being biased into said recess when engaging a respective shoulder to provide a detent restraining said handle operator in a position at which said latch member has been latched and resisting movement of said handle operator driving said rotor to said release position.

15. The apparatus defined in claim 1 wherein said ball cage comprises a cylindrical sleeve having a plurality of holes extending through a wall thereof, said balls being loosely received in said holes, and said holes being formed at a forwardly directed obtuse angle in the direction of rotation of said latch release member to a latching position.

16. The apparatus defined in claim 1 wherein said contact carrier means comprise a tube for each movable bridging contact, said tube being connected to said armature for movement thereby, said movable bridging contact having a rod extending within said tube and axially movable relative to said tube, said rod and said tube being interconnected by a spring to resiliently affix said movable bridging contact to said tube.

17. The apparatus defined in claim 16 wherein one of said tubes extends coaxially through said latch member and said latch member abuts said movable bridging contact when released to drive said bridging contact out of engagement with said stationary contacts.

18. The apparatus defined in claim 17 wherein said spring interconnecting said rod and said tube is a low gradient spring of substantial length to permit said spring biasing said latch member to overcome said interconnecting spring for driving said bridging contact out of engagement with said stationary contacts.

19. The apparatus defined in claim 17 wherein said bridging contacts and said respective pairs of stationary contacts are adapted to form turn-back current paths to generate electromagnetic blow open forces upon high short circuit current conditions, and said low gradient spring resiliently affixing said bridging contact to said tube permitting such movement.

20. The apparatus defined in claim 17 wherein said latch member comprises a transversely extending cross bar rigid therewith and sleeves supported from said cross bar disposed around respective tubes of other movable bridging contacts, said sleeves abutting respective movable bridging contacts when said latch member is released to drive said respective bridging contacts out of engagement with respective stationary contacts.

21. The apparatus defined in claim 20 further comprising manually operable cam means rotatably mounted on said rotary latch means, rotatable about said axis of rotation to drive said latch member axially to said latched position, said cam means comprising at least one pair of diametrically spaced cam surfaces engaging said cross bar.

22. Electromagnetic switching apparatus comprising:

switch contacts operable between open and closed positions;

an electromagnetic operator comprising an armature movable between open and closed positions biased to said open position;

a latch mechanism comprising a linearly movable latch member driven from a latched position to a released position by a spring, said latch member effecting opening of said switch contacts in said released position, and a latch release member rotatable about an axis parallel to linear movement of said latch member to release said latch member, said latch mechanism being disposed between said switch contacts and said electromagnetic operator; and contact carrier means comprising extensible tubular connectors coupling said switch contacts to said electromagnetic operator to effect movement of said contacts to open and closed positions responsive to movement of said armature to open and closed positions, respectively, one of said tubular connectors extending through said latch mechanism coaxially with said axis of rotation of said latch release member.

23. The apparatus defined in claim 22 wherein said latch member comprises three tubular members supported in parallel relation from a common cross bar, a center tubular member disposed coaxially with said latch release member axis of rotation, and each tubular member having one of said tubular connectors extending coaxially therethrough.

24. The apparatus defined in claim 23 wherein said latch member tubular members effect extension of said tubular connectors when driven to said released position to move said contacts to said open position in response to release of said latch mechanism.

25. The apparatus defined in claim 24 wherein said extensible tubular connectors each comprise a tube, an internal rod axially movable with respect to said tube, and a low gradient spring connecting said rod to said tube.

26. The apparatus defined in claim 23 wherein said latch mechanism is symmetrical about said axis of rotation, thereby being dynamically balanced about said axis.

27. The apparatus defined in claim 26 wherein said latch mechanism comprises an electric motor, said latch release member comprising a rotor of said motor, and means limiting rotation of said rotor to a partial revolution between latch engaged and latch released positions.

28. The apparatus defined in claim 27 further comprising means biasing said rotor toward said latch engaged position.

29. The apparatus defined in claim 28 further comprising a manual operator rotatable about said axis of rotation, and means coupling said manual operator to said rotor when said manual operator is rotated in a first direction to move said rotor to said latch released position.

30. The apparatus defined in claim 29 further comprising a cam rotatable about said axis of rotation, and means coupling said manual operator to said cam when said manual operator is rotated in a second direction opposite said first direction to rotate said cam in said second direction, said cam thereby driving said latch member to said latch position against bias provided by said spring.

31. The apparatus defined in claim 30 wherein said manual operator is movable relative to said cam, and said latch member prevents movement of said cam in said first direction.

32. The apparatus defined in claim 31 wherein said manual operator moves said cam to a non-interfering position with respect to said latch member when said latch member is in said latched position.

33. The apparatus defined in claim 32 wherein said means coupling said manual operator to said cam comprises a spring loaded pin in said handle operator and a plurality of unidirectionally oriented shoulders equally spaced along the periphery of said cam engaged by said pin.

34. The apparatus defined in claim 33 wherein said motor comprises a pair of end plates secured to a housing, a cylindrical sleeve bearing positioned between said end plates coaxially with said axis of rotation, and said rotor is rotatably journaled on said sleeve bearing.

35. The apparatus defined in claim 34 wherein said sleeve bearing has a plurality of holes in a wall thereof at equally spaced intervals, said latch member center tubular member is disposed within said sleeve bearing and has a frustoconical latching surface on the exterior thereof, and said rotor has recesses spaced at intervals equal to said spaced intervals of said holes, further comprising balls disposed in said holes held by said rotor against said latching surface to retain said latch member in said latched position, and rotation of said rotor to said latch released position aligns said recesses in registration with said holes permitting said balls to move into said recesses, releasing said latch member.

36. The apparatus defined in claim 35 wherein said means limiting rotation of said rotor comprises pins on said rotor projecting into arcuate slots in one of said end plates.

37. The apparatus defined in claim 36 wherein said means coupling said manual operator to said rotor comprises slots in said manual operator, said pins projecting through said end plate arcuate slots into said manual operator slots.

38. The apparatus defined in claim 37 wherein said means biasing said rotor toward said latched position comprises springs disposed in said handle operator slots abutting said pins.

39. A combination contactor and circuit breaker comprising:

spaced pairs of stationary contacts;

bridging contacts reciprocally movable into and out of engagement with respective pairs of said stationary contacts;

electromagnetic operator means having a pivotally mounted clapper armature;

axially extendable tubular coupling members coupling said bridging contacts to said armature, said coupling members including means biasing said coupling members to non-extended conditions;

cylindrical sleeves individually disposed around said tubular coupling members slidable coaxially with respect to said coupling members, said sleeves being interconnected for unitary movement, and an external latching surface on one of said sleeves;

spring means biasing said sleeves into engagement with said bridging contacts, extending said coupling members and driving said bridging contacts out of engagement with said respective pairs of stationary contacts;

latch means disposed around said one of said sleeves engaging said latching surface latching said sleeves against the bias of said spring means out of engagement with said bridging contacts, said latch means further comprising a release member rotatable concentrically about said one of said sleeves effecting disengagement of said latch means from said latching surface.

* * * * *